US006174031B1

(12) United States Patent
Lindgren et al.

(10) Patent No.: US 6,174,031 B1
(45) Date of Patent: Jan. 16, 2001

(54) ACTUATOR HANDLE FOR AN OFFICE CHAIR

(75) Inventors: Larry Lindgren, Kentwood; Michael Ensley, Holland, both of MI (US)

(73) Assignee: Haworth, Inc., Holland, MI (US)

( * ) Notice: Under 35 U.S.C. 154(b), the term of this patent shall be extended for 0 days.

(21) Appl. No.: 09/326,945

(22) Filed: Jun. 7, 1999

(51) Int. Cl.[7] ..... A47C 31/00

(52) U.S. Cl. ..... 297/463.1; 297/300.8; 297/303.5

(58) Field of Search ..... 297/463.1, 463.2, 297/300.1, 302.1, 300.8, 303.1, 303.3, 303.5

(56) References Cited

U.S. PATENT DOCUMENTS

| | | | | |
|---|---|---|---|---|
| 2,749,903 | | 6/1956 | Auster . | |
| 3,156,004 | | 11/1964 | Strien et al. . | |
| 4,394,048 | | 7/1983 | Sakurai et al. . | |
| 5,129,283 | | 7/1992 | Koehler . | |
| 5,417,474 | * | 5/1995 | Golynsky | 297/302.1 |
| 5,685,607 | * | 11/1997 | Hirschmann | 297/300.8 |
| 5,979,984 | * | 11/1999 | DeKraker et al. | 297/300.8 |
| 6,003,943 | * | 12/1999 | Schneider | 297/303.3 |

OTHER PUBLICATIONS

U.S. application No. 09/016,371, filed Jan. 30, 1998, Courtesy copies of the drawings are attached hereto.

* cited by examiner

*Primary Examiner*—Anthony D. Barfield
(74) *Attorney, Agent, or Firm*—Flynn, Thiel, Boutell & Tanis, P.C.

(57) ABSTRACT

A chair tilt control mechanism includes an actuator handle for locking and unlocking the tilt control mechanism. The actuator handle is a self-contained assembly which is readily mountable to the chair, and includes a hollow housing and a rotatable shaft which is rotatably supported on the housing. The housing includes a V-shaped camming surface and the shaft includes a radial projection which slides axially and circumferentially along the camming surface to positively define locked and unlocked position for actuator handle. The radial projection also defines a stop which allows assembly of the housing and shaft together without fasteners while preventing disassembly when engaged with the camming surface.

20 Claims, 5 Drawing Sheets

ACTUATOR HANDLE FOR AN OFFICE CHAIR

FIELD OF THE INVENTION

The invention relates to a tilt control mechanism for an office chair and more particularly, to an actuator handle for operating the tilt control mechanism.

BACKGROUND OF THE INVENTION

Conventional office chairs typically include a seat-back arrangement which is connected to a base or pedestal. Such seat-back arrangements often are connected to the base by a tilt control mechanism which permits tilting of the seat-back arrangement relative to the base to increase comfort for an occupant. In particular, a seat-back arrangement typically includes a seat assembly and a back assembly which are connected together by the tilt control mechanism wherein the seat assembly tilts forwardly and/or rearwardly relative to the base while the back assembly may either move in unison with the seat assembly or tilt independently of and relative to the seat assembly.

Such tilt mechanisms often include a lock mechanism which provides the ability to lock out forward and/or rearward tilting if desired by the occupant. In such an instance, a manually-actuatable handle is connected to the lock mechanism and is operable by the occupant to lock and unlock the tilt control mechanism. Many different actuator handles have been provided although some of these known handles have been relatively complex wherein a significant number of component parts have been used.

It is an object of the invention therefore to overcome the disadvantages associated with relatively complex actuator handles and provide an actuator handle which uses a minimum number of component parts and is easy to assemble.

The invention relates to an actuator handle for use with a tilt control mechanism of an office chair and in particular, the inventive actuator handle operates a tilt lock mechanism which locks and unlocks forward and/or rearward tilting of the chair. The actuator handle as disclosed herein is connected to the tilt lock mechanism although the actuator handle is also usable with other mechanisms of conventional tilt control mechanisms, for example, to lock out a sliding seat.

The actuator handle includes a housing and a rotatable shaft which are joined together without fasteners. In particular, the shaft includes a radial projection which fits through a keyed opening in the housing and then is rotated to prevent disengagement of the shaft from the housing.

To define positive positions, i.e. a locked position and an unlocked position, for the actuator handle, the inventive handle includes a camming arrangement between the shaft and housing. In particular, the end of the housing includes a V-shaped camming surface which cooperates with the radial projection wherein the radial projection both rotates and slides axially along the V-shaped camming surface during rotation of the shaft. A spring acts axially between the housing and shaft to resist axial movement of the shaft such that the radial projection snaps between locked and unlocked positions as it slides along the camming surface.

This arrangement provides a minimum number of component parts and is readily assembled together without fasteners by inserting the shaft into the housing and then rotating the shaft to move the radial projection into engagement with the camming surface.

Other objects and purposes of the invention, and variations thereof, will be apparent upon reading the following specification and inspecting the accompanying drawings.

Figure 1:
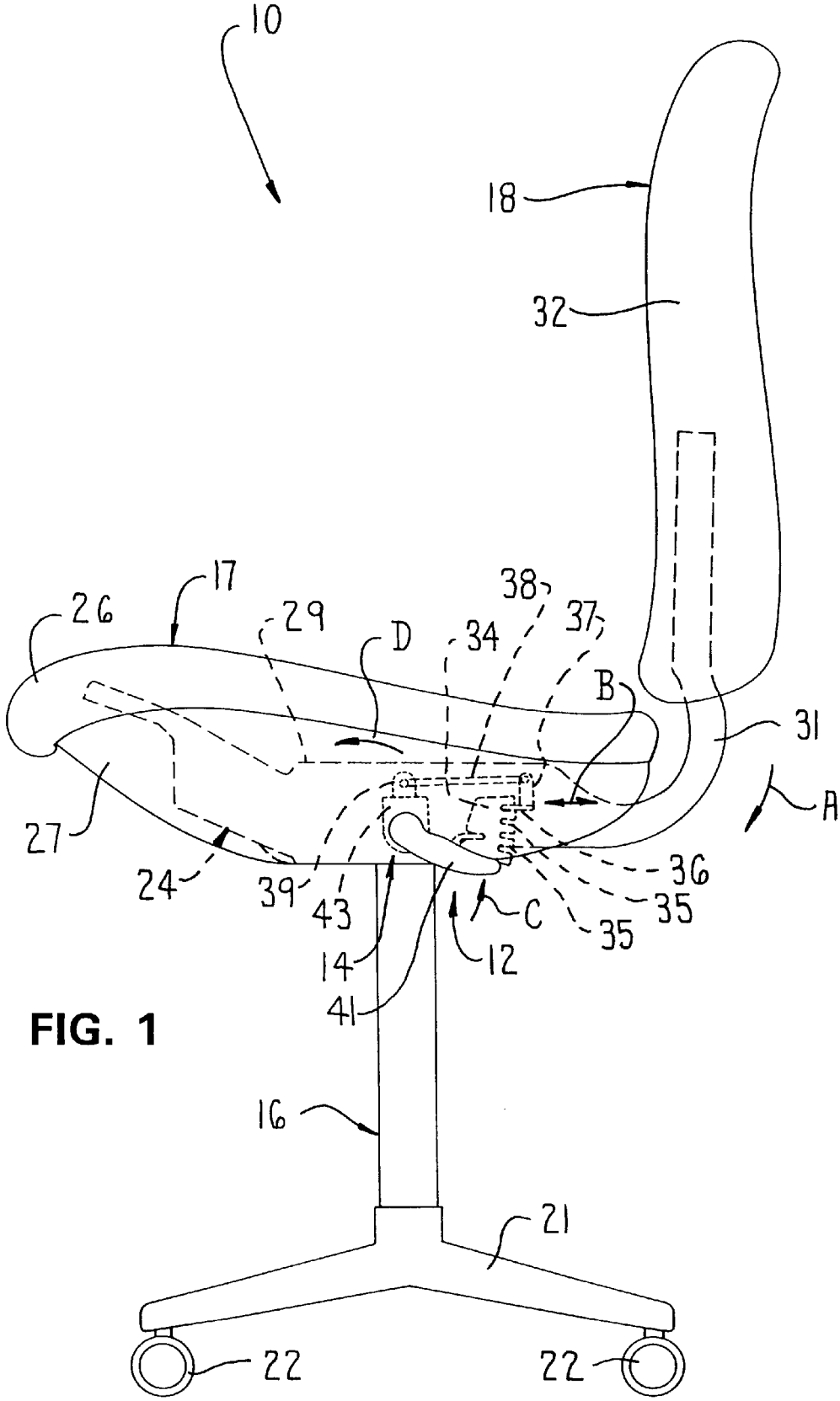
FIG. 1 is a side elevational view of an office-type chair and an actuator handle of the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, a chair 10 is illustrated having a tilt lock mechanism 12 which includes an improved actuator or tilt lock handle assembly 14. The handle assembly 14 is actuatable between locked and unlocked positions to respectively prevent and permit rearward tilting of the chair 10.

The handle assembly 14 is readily usable with a variety of chairs 10 and tilt lock mechanisms 12, and thus, the chair 10 may be of any construction. An example of the chair 10 is sold by the assignee of this application under the trademark ACCOLADE which chair 10 is diagrammatically illustrated in FIG. 1. The chair 10 includes a base 16, a seat assembly 17 which is supported on the base 16, and a back assembly 18. The back assembly 18 is pivotally connected to the base 16 by a tilt control mechanism 24 wherein the back assembly 18 and seat assembly 17 tilt rearwardly relative to the base 16 while the back assembly 18 tilts relative to the seat assembly 17.

The base 16 includes a pedestal 21 having casters 22 disposed in load bearing relation with a floor and the upper end of the pedestal 21 includes the tilt control mechanism 24. The tilt control mechanism 24 for the most part is enclosed by the seat assembly 17 which includes a seat cushion 26 that is horizontally enlarged to support a user thereon. The seat assembly 17 also includes an outer cover 27 which encloses the underside of the chair 10. Typically, the outer cover 27 is a pan-shaped component which defines a hollow interior within the seat assembly 17, in which the tilt mechanism 24 is substantially enclosed.

More particularly, the tilt control mechanism 24 includes a tilt control housing 29 which is rigidly supported on the upper end of the pedestal 21. The housing 29 supports the seat assembly 17 and specifically, the cushion 26 and outer cover 27.

The housing 29 also pivotally supports the back assembly 18 thereon. In particular, the back assembly 18 includes an L-shaped rigid upright 31. The forward end of the upright 31 is pivotally connected to the tilt control housing 29 in a conventional manner, and an upper end of the upright 31 extends upwardly above the rear edge of the seat assembly 17 and supports a back cushion 32. The tilt mechanism 24 normally biases the upright 31 to an upright position as illustrated in FIG. 1 while permitting downward pivoting of the upright 31 relative to the housing 29 generally in the direction of reference arrow A. As a result, the back assembly 18 effectively tilts rearwardly relative to the seat assembly 17.

While the tilt mechanism 24 normally biases the back assembly 18 to the upright position, the tilt lock mechanism 12 permits locking of the back assembly 18, for example, in a rearwardly tilted position. The tilt mechanism 24 therefore includes a lock bracket 34 which is rigidly supported on the rear edge of the tilt control housing 29. The lock bracket 34 therefore remains stationary during rearward tilting of the upright 31. The lock bracket 34 includes a plurality of vertically spaced notches 35 which open rearwardly and each define a corresponding rearwardly tilted position for the back assembly 18.

To effect locking of the back assembly 18 in one of these tilted positions, a horizontally elongated lock lever 36 is pivotally connected to the upright 31. In particular, the lock lever 36 is pivotable forwardly and rearwardly about a pivot axis which extends generally vertically. As a result, a free end of the lock lever 36 is movable forwardly into a corresponding one of the notches 35 to a locked position (as seen in FIG. 1) or rearwardly out of the notch 35 to an unlocked position. This forward and rearward movement of the lock lever 36 is generally identified by reference arrow B.

Since the lock lever 36 is supported on and therefore movable with the pivoting upright 31, the lock lever 36 when engaged with the notch 35 prevents pivoting movement of the upright 31 relative to the tilt control housing 29 on which the lock bracket 34 is supported. When the lock lever 36 is swung rearwardly out of the corresponding notch 35, the lock lever 36 moves with the upright 31 and therefore, moves vertically relative to the plurality of notches 35 as the upright 31 tilts downwardly. When the upright 31 is pivoted downwardly, the lock lever 36 may be selectively engaged with one of the lower notches 35 so as to lock the upright 31 in a pivoted or rearwardly tilted position. The lock lever 36 may thereafter be released to permit continued upward or downward pivoting of the upright 31 in response to a user.

To effect movement of the lever 36 between the locked and unlocked positions, the lock lever 36 includes an upstanding flange 37. The flange 37 is connected to the rearward end of a horizontal connector rod 38, while the forward end of the connector rod 38 is connected to the handle assembly 14. To effect movement of the connector rod 38, the handle assembly 14 includes a handle 41 which has a connector flange 39 thereon. The handle 41 drives the connector flange 39 such that movement of the handle counter-clockwise in the direction of reference arrow C causes movement of the flange 39 forwardly in the direction of reference arrow D. Accordingly, once the handle 41 is moved in the direction of arrow C by a user, the connector rod 38 pulls the flange 37 on the lock lever 36 forwardly so as to cause rearward movement of the opposite free end of the lever 36. The lever 36 thereby is moved rearwardly out of the corresponding notch 35 to permit pivoting of the upright 31. Conversely, the handle 41 can be moved clockwise in the opposite direction to cause the lever 36 to be pivoted from the unlocked position to one of the locked positions within a selected one of the notches 35.

The general structure and operation of this tilt lock mechanism 12 is conventional and is currently being used in the assignee's ACCOLADE chair.

The tilt lock mechanism 12, however, incorporates an improved tilt lock handle assembly 14 (FIGS. 2–10) which is the subject of this application. More particularly referring to FIGS. 1–3, the improved tilt lock handle assembly 14 is removably connected to the chair base 16 and is preferably connected to the tilt control housing 29 so as to be rigidly supported thereon.

Generally, the handle assembly 14 includes a housing or support 43 which rotatably supports the actuator handle 41. The housing 43 is rigidly connected to the tilt control housing 29 by any suitable mounting means. In the preferred embodiment, the handle housing 43 is removably connected to the tilt control housing 29 by threaded fasteners 44. The handle 41 is rotatably supported by the housing 43 to permit a user to rotate the handle 41 between locked and unlocked positions and thereby actuate the tilt lock mechanism 12, the structure and function of which are described above.

The fasteners 44 are threaded downwardly into the housing 43. For assembly and disassembly, the seat cushion 26 must be removed. The seat cushion 26 thereby prevents removal of the tilt lock assembly when the fasteners 44 are covered thereby.

More particularly with respect to the handle 41, the handle 41 includes a handpiece 48 which is generally flat but cupped to facilitate manual gripping by a user. The handpiece 48 further includes a generally cylindrical mounting end 49 on one side thereof which is offset to define a leading forward edge of the handpiece 48 as illustrated in FIG. 4, while the remaining cupped section of the handpiece 48 extends rearwardly therefrom.

Figure 2:
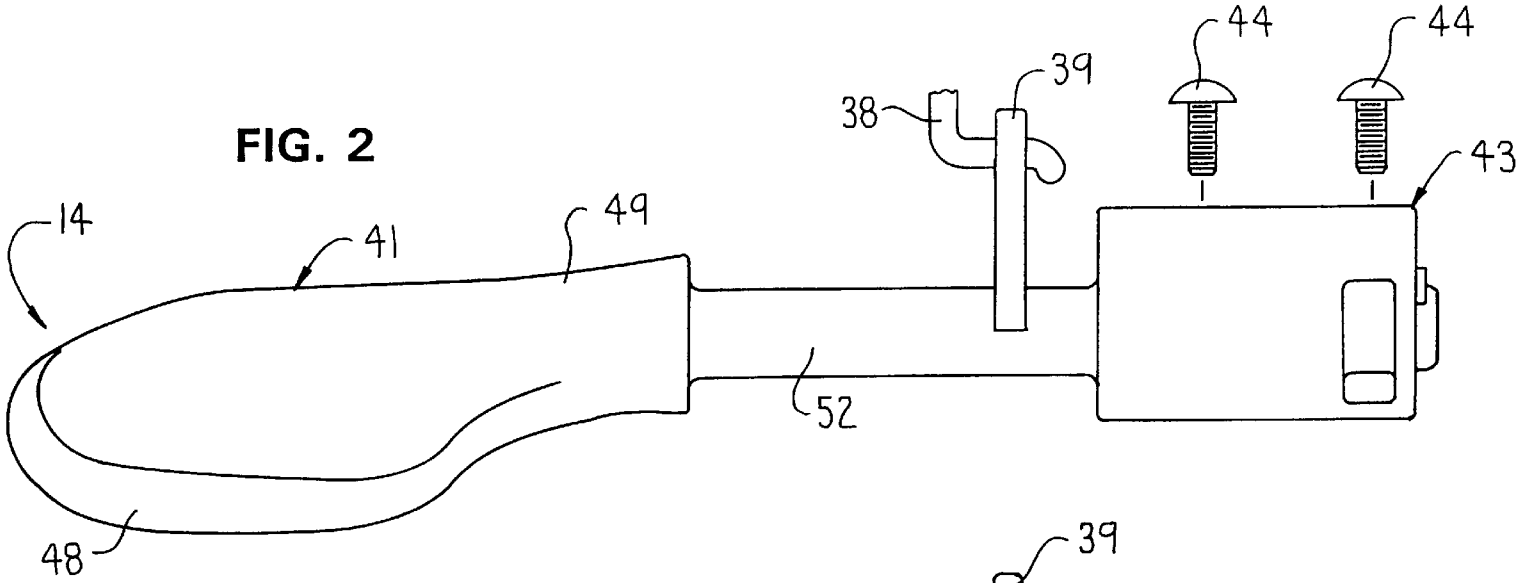
FIG. 2 is a rear elevational view of the actuator handle.
Figure 3:
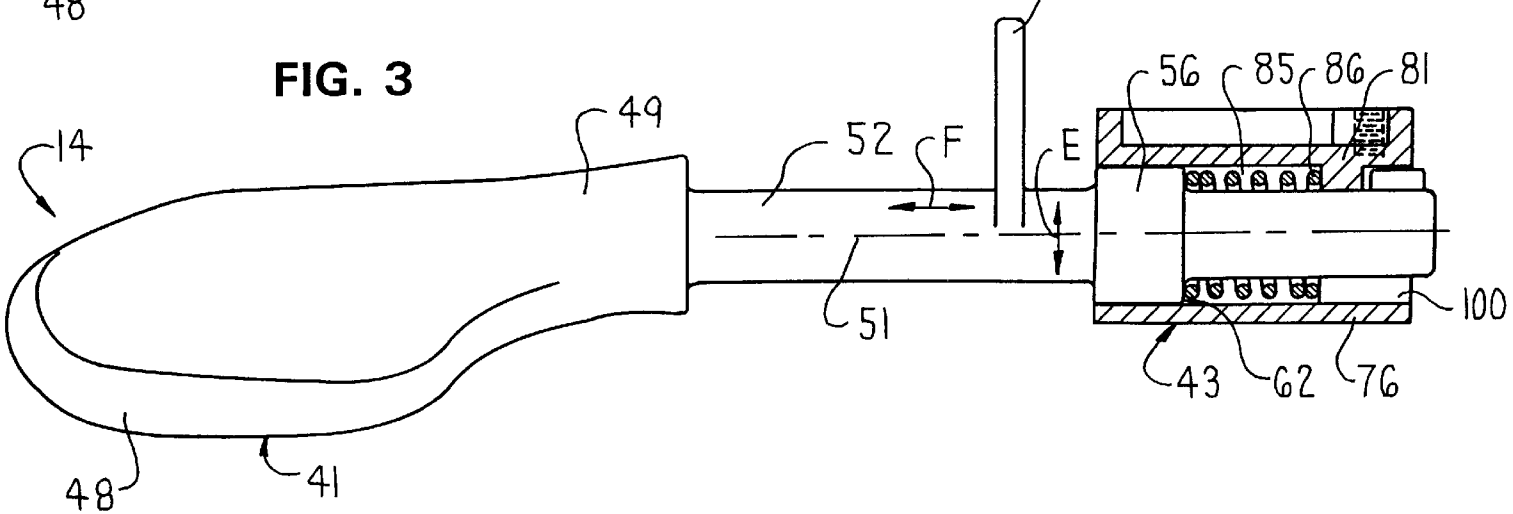
FIG. 3 is a rear elevational view of the actuator handle in partial cross section as taken along line 3—3 of FIG. 4.
Figure 6:
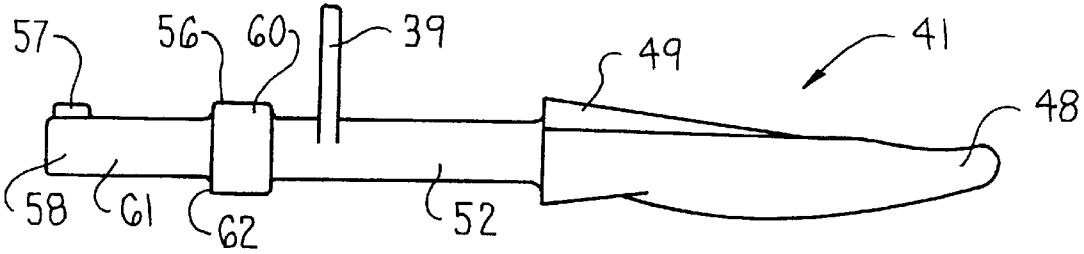
FIG. 6 is a front elevational view of the handle shaft.

Referring to FIGS. 2 and 3, the mounting end 49 is joined to an outer end of a horizontally elongate shaft 52. The shaft 52 defines a central axis 51 about which the shaft 52 rotates. The shaft 52 preferably has a cylindrical shape and includes the connector flange 39 projecting radially therefrom. The radially outermost end of the connector flange 39 includes a bore 53 (FIG. 4) which receives a stepped forward end of the connector rod 38 as seen in FIGS. 1 and 2.

Figure 4:
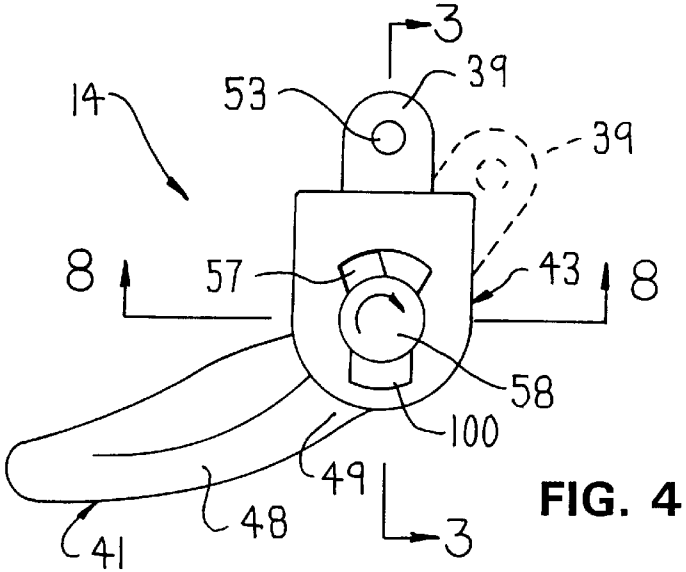
FIG. 4 is a left side elevational view of the actuator handle.

As seen in FIG. 4, when the connector flange 39 is oriented vertically, the handpiece 48 extends generally horizontally and rearwardly away therefrom. Thus, when a user presses on the cupped section of the handpiece 48, a torque is applied to the shaft 52 which effects rotation or rotary movement of the connector flange 39 about axis 51 between a first position illustrated in solid outline in FIG. 4 and a second position as illustrated in phantom outline therein. The skilled artisan will appreciate that alternative methods other than the flange 39 and rod 38 may be used to connect the shaft 52 to the remainder of the tilt lock mechanism so that rotation of the shaft 52 effects locking and unlocking thereof. For example, gears, belts, levers or the like parts may be used.

To both rotatably support the shaft 52 within the shaft housing 43 and also positively restrain the shaft 52 either in the first or second positions (FIG. 4), the shaft 52 further includes a circumferential shoulder 56 (FIG. 6) and a radial projection 57 which is spaced axially from the shoulder 56 and cooperates with the housing 43 as will be described herein.

The shoulder 56 preferably projects radially outwardly from an elongate end section 58 of the shaft 52. In particular, the shoulder 56 and the shaft end section 58 are defined by respective exterior circumferential surfaces 60 and 61 wherein the diameter of the exterior shoulder surface 60 is greater than the diameter of the exterior shaft surface 61 thereof. The shoulder 56 thereby defines an abutment surface 62 which extends radially between the exterior surfaces 60 and 61 and faces axially toward the radial projection 57.

Figure 7:
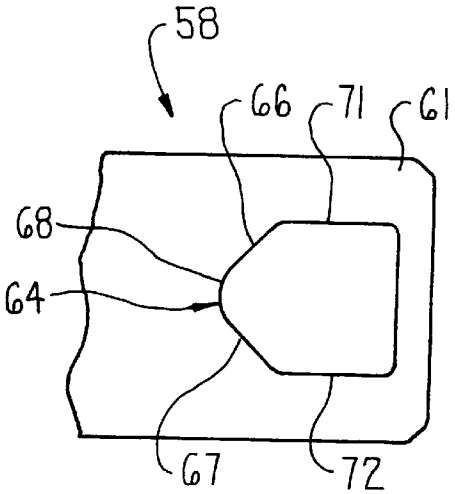
FIG. 7 is a partial plan view of an inner end of the shaft.

Referring to FIG. 7, the radial projection 57 extends outwardly from the exterior surface 61 of the end section 58 and includes a generally V-shaped end 64 which points axially toward the shoulder 56. The V-shaped end 64 is defined by first and second camming surfaces 66 and 67 which converge axially and circumferentially toward an apex 68. Preferably, the camming surfaces 66 and 67 are substantially planar while the apex 68 curves therebetween such that it is rounded. The radial projection 57 also includes opposite side surfaces 71 and 72 which face in opposite circumferential directions.

Preferably the entire shaft 52 including the connector flange 39, shoulder 56 and radial projection 57 are formed as a one-piece component, preferably of plastic.

More particularly with respect to the handle housing 43, the housing 43 is adapted to rotatably support the handle shaft 52 therein as illustrated in FIGS. 3 and 4. Further, the housing 43 and radial projection 57 of the shaft 52 are in snap-locking or in other words over-center engagement such that the handle 41 positively snaps between and is retained in either the locked or the unlocked positions of FIG. 4.

Figure 8:
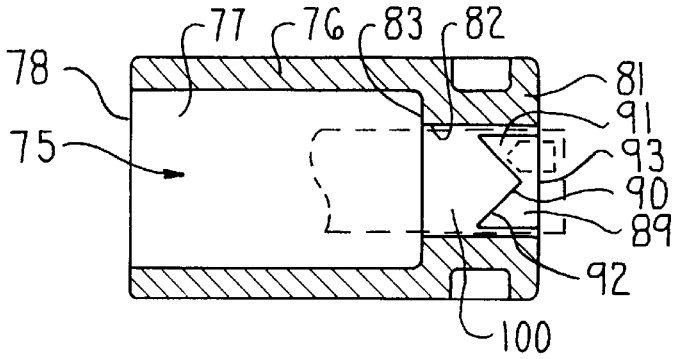
FIG. 8 is a bottom view in cross section of the housing as taken along line 8—8 of FIG. 4.

The housing 43 preferably is formed as a one-piece molded plastic component having a hollow interior or bore 75 as seen in FIG. 8. In particular, the housing 43 includes a circular, cylindrical outer wall 76 (FIGS. 8 and 9) which defines a circular interior wall surface 77 which opens axially through an open end 78 thereof. The wall surface 77 has an inside diameter which is proximate but slightly larger than the outer diameter of the shoulder 56 as seen in FIG. 3 to permit relative movement therebetween.

The shoulder 56 not only is rotatable in the hollow interior 75 as indicated generally by reference arrow E but also is movable axially within the hollow interior 75 as generally indicated by reference arrow F. The housing 43 further includes an end wall 81 (FIGS. 8 and 9) which is adapted to receive the free inner end of the shaft end section 58 therethrough (FIGS. 3–5) as will be described in more detail herein.

The end wall includes an opening 82 through which the end section 58 extends. The opening 82 has a diameter which is closely proximate the end section 58 so as to provide support to the end section 58 while permitting rotational and axial movement thereof.

The end wall 81 includes an inner face 83 which faces axially toward the handpiece 48. The inner face 83 therefore is disposed in opposing but axially spaced apart relation with the abutment surface 62 defined on the shoulder 56. Since the diameter of the end section 58 is smaller than the diameter of the outer wall 76, the exterior surface 61 of the end section 58 and the wall surface 77 of the housing 43 are disposed in opposing but radially spaced apart relation such that an annular spring cavity 85 is defined therebetween as seen in FIG. 3.

The spring cavity 85 includes biasing means acting between the opposing inner face 83 and abutment surface 62 so as to bias these opposing surfaces away from each other. Preferably, the biasing means comprises a coil spring 86 which is disposed in surrounding concentric relation with the shaft end section 58. The coil spring 86 is disposed in compression with the opposite ends thereof acting axially upon the respective abutment surface 62 and inner face 83 to bias the shaft 52 axially away from the housing 43.

Figure 5:
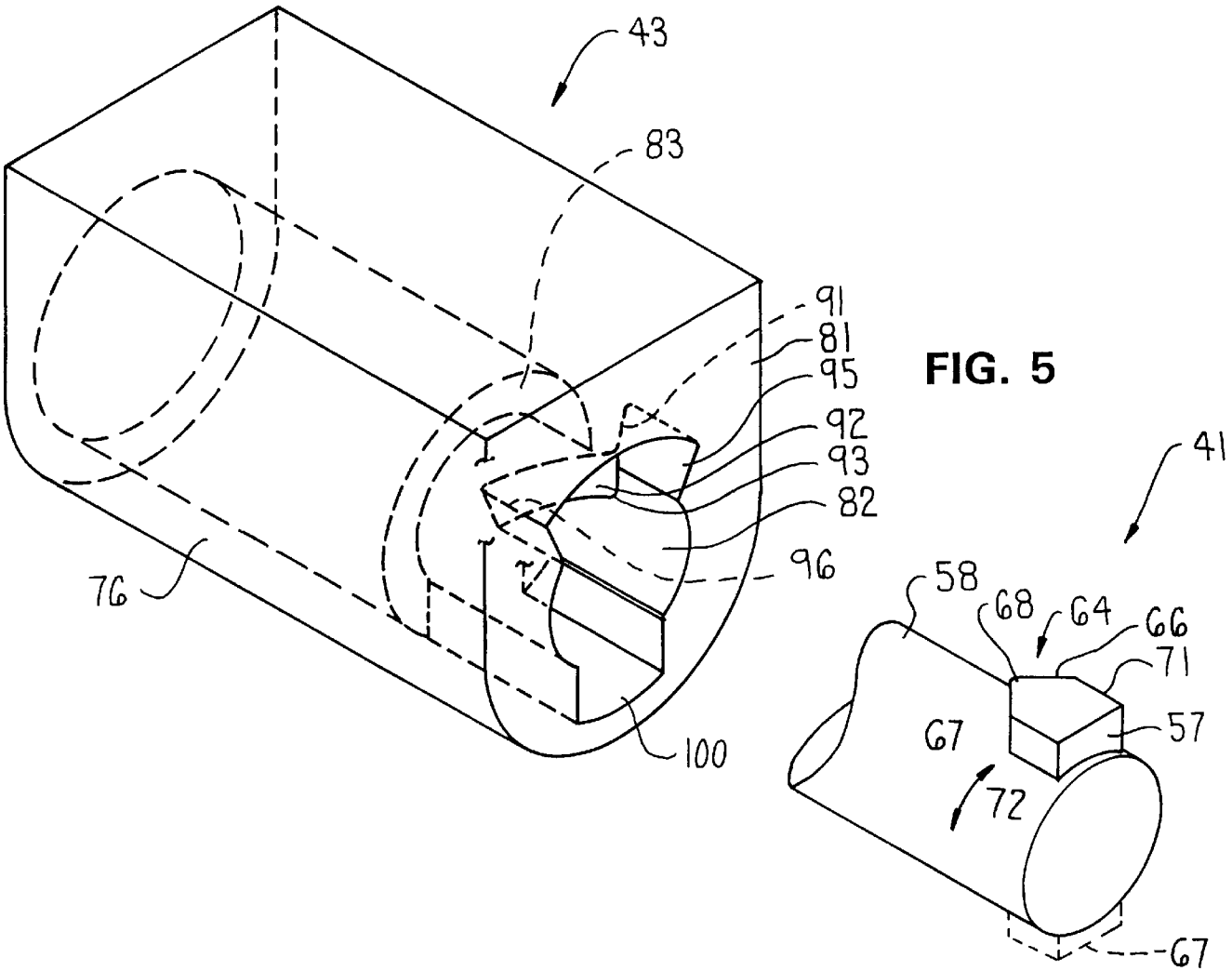
FIG. 5 is an enlarged partial perspective view of a housing and a handle shaft of the actuator handle.

Referring to FIGS. 3, 5 and 8, the end wall 81 also includes a V-shaped notch or recess 89 which is formed at the top of the opening 82. In particular, the recess 89 opens radially inwardly into the opening 82 on one side and opens axially away from the housing 43 on an end thereof. The recess 89 is adapted to receive the radial projection 57 on the shaft 52.

More particularly, the recess 89 (FIG. 8) defines a V-shaped end face 90 which comprises camming surfaces 91 and 92 which converge axially toward an apex 93. The end face 90 cooperates with the V-shaped end 64 of the radial projection 57. In particular, the width of the recess 89 is approximately twice the width of the radial projection 57 such that as the spring 86 biases the shaft 52, the radial projection 57 is urged to one side or the other of the apex 93. However, during rotation of the shaft 52, the radial projection 57 is able to slide circumferentially and axially up one of the camming surfaces 91 or 92 and over the apex 93 to the other of the camming surfaces 91 or 92. Since the spring 86 effectively urges the radial projection 57 axially away from the apex 93, the cooperating V-shaped surfaces 64 and 90 positively restrain the shaft 52 in either the locked position or unlocked position. This arrangement, however, permits the shaft 52 to be rotated circumferentially to the other of the locked and unlocked positions wherein the radial projection 57 snap-lockingly moves over-center to either position.

To assist in this regard, the recess 89 includes side surfaces 95 and 96 (FIG. 5) which essentially define stops for the radial projection 57 and thereby limit rotation of the shaft 52 between the locked and unlocked positions.

Figure 9:
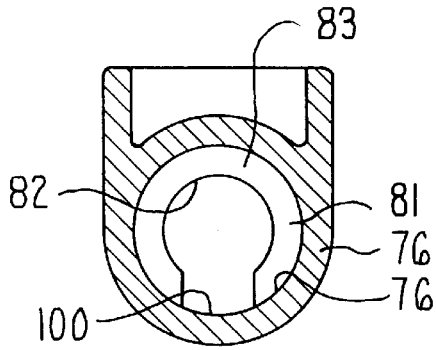
FIG. 9 is a right elevational view in cross section of the housing as taken along line 9—9 of FIG. 10.

To effect assembly of the shaft 52 with the housing 43, the bore 82 and the end wall 81 of the housing 43 also includes an axially elongate keyway or channel 100 (FIGS. 8 and 9). The bore 82 is in communication with the keyway 100 such that the cross-sectional shape of the keyway 100 as seen in FIG. 4 generally corresponds to the shape of the shaft 52 and radial projection 57. As a result, the shaft 52 can be slid through the housing end wall 81 when the radial projection 57 is aligned with the keyway 100.

To assemble the shaft 52 and housing 43 together, the radial projection 57 is oriented so it slides through the keyway 100. Since the shoulder 56 is axially slidable within the housing 43 and the coil spring 86 is compressible, the radial projection 57 is slid through and out of the keyway 100, and once the radial projection 57 is slid entirely through the end wall 81, the shaft 52 is rotated 180° until the radial projection is generally aligned with the open end of the recess 89 as generally seen in FIG. 4. At this time, the shaft 52 can be released such that the coil spring 86 biases the shaft 52 axially until the radial projection 57 is fully seated in the recess 89 on one side or the other of the apex thereof. As a result, the housing 43 and shaft 52 are readily assembled together without fasteners.

While the radial projection 57 is formed integral with shaft 52, the radial projection 57 may be formed separately. If separate, the keyway 100 could be eliminated whereby the radial projection 57 is removed for assembly and then attached to the shaft 52 to prevent disassembly.

Figure 10:
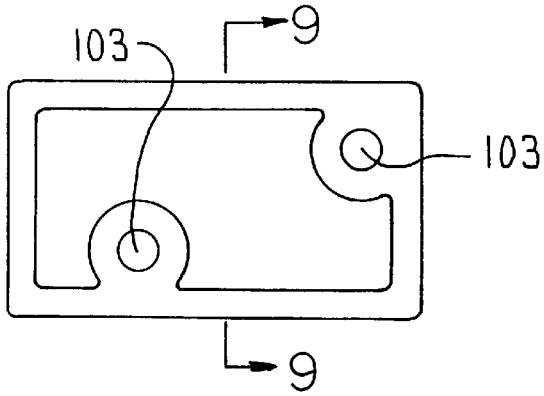

To mount the tilt lock handle assembly 14 to the chair base 16, the upper surface of the housing 43 includes a pair of threaded bores 103 at opposite diagonal corners thereof as seen in FIG. 10. The bores 103 threadingly engage the fasteners 44 such that the housing 43 is rigidly secured to the chair base 16 and supports the shaft 52 thereon. Referring to FIG. 1, the housing 43 preferably is fully enclosed within the hollow interior defined by the seat cover 27. The shaft 52, however, projects outwardly of the seat cover 27 such that the handpiece 48 is accessible by a user. Once the handle assembly 14 is secured to the chair base 16, the connector rod 38 is connected at one end to the connector flange 39 and at the other end to the flange 37 on the lock lever 36.

In operation, the handpiece 48 can be rotated between the locked and unlocked positions to move the lock lever 36 therebetween. Since the shaft 52 is also axially movable, rotation of the shaft 52 causes the radial projection 57 to slide axially and circumferentially up and over the apex 93 formed in the corresponding recess 89 of the housing 43. Thus, the shaft 52 is positively restrained in either the locked or unlocked position and inadvertent engagement or disengagement of the entire tilt lock mechanism 12 is prevented.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chair having a base, a seat assembly and a tilt mechanism connecting said seat assembly to said base so as to permit tilting of said seat assembly relative to said base, said tilt mechanism being actuatable between locked and unlocked positions to respectively prevent and permit said tilting of said seat assembly and including an actuator handle to lock and unlock said tilt mechanism, comprising the improvement wherein said actuator handle includes a housing which is supported on said seat assembly and includes an elongate bore extending axially therethrough, said actuator handle further including a manually-rotatable shaft having an end which is inserted axially into an open end of said bore, said shaft having an outer surface rotatably supported by an interior bore surface in said bore so as to be rotatably and axially movable relative thereto, at least one of said housing and said shaft including a generally V-shaped camming surface that includes first and second sides which face axially and converge to a peak, said camming surface extending radially away from said interior bore surface and the other of said housing and said shaft including a radial projection which slidably contacts said camming surface, said actuator handle including a biasing member which biases said shaft axially such that said radial projection is urged axially to either of said first and second sides, said biasing member permitting axial displacement of said shaft such that said radial projection slides circumferentially and axially over said peak between said first and second sides during rotation of said shaft, said tilt mechanism respectively being locked and unlocked when said radial projection is disposed on said first and second sides of said camming surface.

2. The chair according to claim 1, wherein said biasing member includes a first part connected to said housing and a second part connected to said shaft to bias said radial projection radially and axially.

3. The chair according to claim 2, wherein said shaft and said housing define axially opposed surfaces and said biasing member comprises a spring disposed in compression between said opposed surfaces.

4. The chair according to claim 3, wherein said shaft includes an annular rim which defines one of said opposed surfaces and said spring is a coil spring.

5. The chair according to claim 1, wherein said housing includes an end wall which rotatably supports an end of said shaft, and said shaft includes an annular wall which projects radially and is rotatably supported in said bore, said biasing member acting axially between said end wall and said annular wall.

6. The chair according to claim 1, wherein said housing is disposed on an under side of said seat assembly.

7. The chair according to claim 1, wherein said radial projection moves axially between said first and second sides solely by rotation of said shaft.

8. The chair according to claim 1, wherein said first and second sides of said camming surface are symmetrical relative to said peak.

9. In a chair having a base, a seat assembly and a tilt mechanism connecting said seat assembly to said base so as to permit tilting of said seat assembly relative to said base, said tilt mechanism being actuatable between locked and unlocked positions and including an actuator to lock and unlock said tilt mechanism to respectively prevent and permit said tilting of said seat assembly, comprising the improvement wherein said actuator includes a housing removably fixed on said seat assembly and an axially elongate shaft supported on said housing so as to be rotatably and axially movable relative thereto, said shaft including a radial projection at an inner end thereof and a handle at an opposite outer end thereof, said housing including a bore extending axially therethrough and an end wall at one end of said bore, said end wall including a camming surface and a keyed opening which is defined by a central open section and a radial open section extending radially from the central open section, said central open section receiving said inner end of said shaft therethrough and permitting rotation of said shaft such that said radial projection is inserted through said radial open section when said shaft is in a first orientation and abuts against said camming surface and prevents removal of said shaft from said housing when said shaft is rotated to a second orientation, said camming surface including first and second sides which converge axially to a peak, said radial projection being slidable circumferentially along said camming surface in response to rotation of said shaft by a user such that said radial projection slides axially upper and over said peak between first and second positions defined on said first and second sides respectively, said tilt mechanism being respectively locked and unlocked when said radial projection is in said first and second positions.

10. The chair according to claim 9, wherein said camming surface is generally V-shaped.

11. The chair according to claim 9, which includes a biasing member which acts between said housing and said shaft to bias said radial projection to either said first position or said second position while permitting said circumferential and axial movement of said radial projection therebetween.

12. The chair according to claim 11, wherein said biasing member biases said shaft axially.

13. The chair according to claim 11, wherein said biasing member acts on said end wall of said housing and biases said shaft axially away from said end wall.

14. The chair according to claim 9, wherein said radial projection is V-shaped and points axially towards said camming surface.

15. An actuator handle for a chair comprising:

a hollow housing having an elongate bore extending therethrough, said bore having an open end and an opposite inner end adjacent an end wall of said housing, said housing including connector parts thereon which are engagable with fasteners to permit mounting of said actuator handle to a chair, said end wall having a wall opening which opens axially therethrough and a camming surface defined in a side face of said end wall which faces axially, said camming surface being disposed radially outwardly of said wall opening and projecting axially to define side surfaces which converge toward each other;

an axially elongate shaft having inner end which extends through said wall opening and is rotatably supported therein and an outer end which projects outwardly from said bore and includes a handle thereon, said shaft defining an outer circumferential surface which is rotatably supported in said bore, said inner end including a radial projection which rotates therewith and cooperates with said camming surface so as to be movable radially and axially along said camming surfaces between said side surfaces; and a spring acting between said housing and said shaft to bias said radial projection axially toward said camming surface, said housing and said shaft being joined together to define a self-contained unit which is mountable to a chair.

16. The actuator handle according to claim 15, wherein said shaft moves axially in said bore as said radial projection moves between said side surfaces of said camming surface.

17. The actuator handle according to claim 15, wherein said wall opening is substantially circular but includes a keyway which projects radially outwardly to receive said radial projection axially therethrough and is circumferentially spaced from said camming surface such that said radial projection prevents removal of said shaft from said housing when disposed in cooperation with said camming surface.

18. The actuator handle according to claim 17, wherein said shaft includes an annular collar which defines said circumferential surface, said annular collar and said end wall defining opposed surfaces, said spring biasing said opposed surfaces away from each other such that said radial projection presses against said camming surface.

19. The actuator handle according to claim 18, wherein said spring is a coil spring and said shaft extends axially through said spring.

20. The actuator handle according to claim 15, wherein said shaft includes a connector part for actuating a chair mechanism, said connector part being disposed outwardly of said housing and being rotatable with said shaft between first and second positions.

* * * * *